US008372219B2

(12) United States Patent
Caliskanoglu et al.

(10) Patent No.: US 8,372,219 B2
(45) Date of Patent: Feb. 12, 2013

(54) GUN BARREL OF FIREARMS

(75) Inventors: Devrim Caliskanoglu, Bruck/Mur (AT); Herbert Schweiger, Wartberg (AT); Ingo Siller, Semriach (AT)

(73) Assignee: Boehler Edelstahl GmbH & Co. KG, Kapfenberg (AT)

( * ) Notice: Subject to any disclaimer, the term of this patent is extended or adjusted under 35 U.S.C. 154(b) by 30 days.

(21) Appl. No.: 13/080,268

(22) Filed: Apr. 5, 2011

(65) Prior Publication Data

US 2011/0253270 A1 Oct. 20, 2011

(30) Foreign Application Priority Data

Apr. 6, 2010 (AT) ..... A 550/2010

(51) Int. Cl.
*C22C 38/22* (2006.01)
*C22C 38/24* (2006.01)
*C21D 9/10* (2006.01)

(52) U.S. Cl. ..... 148/334; 148/335; 148/663; 420/111; 42/75.02; 42/75.1

(58) Field of Classification Search ..... 420/111; 148/320, 333–335, 663; 42/76.01, 76.02, 42/76.1

See application file for complete search history.

(56) References Cited

U.S. PATENT DOCUMENTS 1,346,188 A * 7/1920 Fahrenwald ..... 42/76.02
2,876,095 A * 3/1959 Dickerson ..... 420/83
3,780,465 A * 12/1973 Polcha ..... 148/565
4,622,080 A * 11/1986 Wegwerth ..... 148/211

FOREIGN PATENT DOCUMENTS

EP 0 469 591 12/1991
JP 2000-080444 3/2000

OTHER PUBLICATIONS

W.Ed.Wegst, "Some Facts About Alloying and Accompanying Elements in Steel", Wegst C W-Stahschlussel Stahlsclessel, NNachschlagewerk, Marbach, Verlage Stahlschlussel Wegst, DE, vol. ED 1989, p. 6.*

* cited by examiner

*Primary Examiner* — Deborah Yee

(74) *Attorney, Agent, or Firm* — Greenblum & Bernstein, P.L.C.

(57) ABSTRACT

Gun barrel for firearms made from a deformed material and method for producing the gun barrel material. The material has a chemical composition in % by weight of:

| Content | C | Si | Mn | P | S | Cr | Mo |
|---|---|---|---|---|---|---|---|
| Min | 0.28 | 0.08 | 0.15 | | | 3.6 | 1.2 |
| Max | 0.36 | 0.26 | 0.35 | 0.005 | 0.002 | 4.4 | 1.8 |

| Content | Ni | V | W | Ti | As + Sn + Sb | Fe |
|---|---|---|---|---|---|---|
| Min | | 0.42 | | | | Rest |
| Max | <0.5 | 0.5 | 0.15 | 0.08 | 0.007 | |

and impurities due to smelting. The material has a hardness of at least 46 to 48 HRC.

10 Claims, 1 Drawing Sheet

GUN BARREL OF FIREARMS

CROSS-REFERENCE TO RELATED APPLICATIONS

The present application claims priority under 35 U.S.C. §119 of Austrian Patent Application No. A 550/2010, filed on Apr. 6, 2010, the disclosure of which is expressly incorporated by reference herein in its entirety.

BACKGROUND OF THE INVENTION

1. Field of the Invention

The invention relates to a gun barrel of firearms, in particular, for lightweight small arms.

2. Discussion of Background Information

In the practical use of the weapon, a gun barrel is subjected to high mechanical and thermal stresses. A sudden gas pressure load on the barrel or a tensile load on the barrel wall during firing requires a high yield strength or high strength of the barrel material with good toughness properties.

According to the prior art, tested, highly tough quenched and tempered steels are used as barrel materials, which are economically viable. A material hardness of 47±1 HRC is generally required for such a heat treated barrel part, which approximately corresponds to an ultimate tensile strength in the range of 1,030 to 1,125 N/mm$^2$.

Within the scope of improving performance, improving quality and increasing safety, increased demands are made on the gun barrel of firearms and in this manner on the material of the barrel parts. This results mainly from increased gas pressure loads due to new ammunition concepts and lower barrel wall thicknesses to reduce the weight of modern firearms.

SUMMARY OF THE INVENTION

Based on the prior art, embodiments of the invention provide an improved gun barrel for firearms of a new material for this purpose, which is balanced in terms of alloy technology and, after a heat treatment, has a required strength or minimum hardness of greater than 47±1 HRC, a high toughness in the temperature range of −50 to +500° C. and higher, and in this manner, has a security potential against brittle fracture even with a wall thickness minimization.

According to embodiments, the gun barrel is made from a deformed material with a chemical composition in % by weight of:

| Content | C | Si | Mn | P | S | Cr | Mo | Ni | V | W | Ti | As + Sn + Sb | Fe |
|---|---|---|---|---|---|---|---|---|---|---|---|---|---|
| Min | 0.28 | 0.08 | 0.15 | | | 3.6 | 1.2 | | 0.42 | | | | Rest |
| Max | 0.36 | 0.26 | 0.35 | 0.005 | 0.002 | 4.4 | 1.8 | <0.5 | 0.5 | 0.15 | 0.08 | 0.007 | |

and includes impurities due to smelting. The heat treated gun barrel material has a hardness of 46 to 48 HRC.

Compared to a widely used alloy for gun barrels, which has a composition formed in wide limits in % by weight of: C=0.42, Si=0.3, Mn=0.7, P max. 0.025, S max. 0.01, Cr=1.1, Mo=0.2, Ni=0.25, V max. 0.1, W max 0.1, Ti max. 0.1, the new weapon barrel material of the embodiments has highly effective differences in the concentrations of the elements C, Si, Mn, P, S, Cr, Mo, Ni and V. Further, maximum concentrations of As, Sn, and Sb, which are harmful to steel, are greatly reduced.

The main focus of the new gun barrel alloy according to the embodiments of the invention was an increase in the ultimate tensile strength or yield strength at temperatures above approx. 300° C. With a short firing sequence, an advantageously thin or lightweight gun barrel heats up at least in the region of the interior surface to over 400 to 450° C. The material strength and the wear resistance of the known and widely used gun barrel materials are greatly reduced and cause general problems with the increased quality requirements at increased temperatures.

However, other conventional hot-worked steels, which often have high material hardness values in the heat treated state up to 500° C. and also much more, can be used for weapon barrels. Although their high temperature behavior is extremely favorable, the toughness values are comparatively low and the Fracture Appearance Transition Temperature (FAIT) of the material is essentially in the range of +60 to 0° C.

The disadvantages of the quenched and tempered steel and those of a hot worked steel are overcome by the composition of the barrel material according to embodiments of the invention.

In contrast to the above-discussed known alloys, the material according to the invention has a lower C content, which has a favorable impact on the hardness behavior and produces adequate hardness values with a standard heat treatment technology.

For reasons of the material toughness in the low temperature range, the Si content is limited to low values, which if need be definitely cause a deoxidization of the melt.

Low values of Mn are advantageous on condition of low S contents.

A Cr and Mo content that is higher compared to the quenched and tempered steel has an advantageous effect on the tempering behavior of the material and on the high-temperature properties thereof.

As was found, low Ni concentrations are crucial for an improved hydrogen-induced low temperature behavior of the alloy.

Nickel contents of the alloy according to the embodiments can be immediately below 0.5% by weight, and it can be advantageous if a vacuum treatment of the melt is carried out in the production method of the material. Usually, the degassing of the molten steel is thereby carried out at a pressure of less than 5 mbar (500 Pa), preferably 1 m bar (100 Pa) and lower.

Low nickel concentrations of less than 0.18% by weight and in particular of 0.1% by weight of the alloy can render an expensive vacuum treatment superfluous.

Furthermore, for a high toughness of the material, the low contents thereof of As, Sn and Sb are of essential importance.

It is of particular advantage for achieving the highest quality values if the gun barrel composed of a material discussed above, has at least one element in the concentration in % by weight of:

| Content | C | Si | Mn | P | S | Cr | Mo | Ni | V | W | Ti | As + Sn + Sb | Fe |
|---|---|---|---|---|---|---|---|---|---|---|---|---|---|
| Min | 0.3 | 0.1 | 0.2 | | | 3.8 | 1.4 | | 0.44 | | | | Rest |
| Max | 0.34 | 0.2 | 0.3 | 0.005 | 0.001 | 4.2 | 1.6 | 0.1 | 0.48 | 0.1 | 0.05 | 0.005 | |

A method for producing a gun barrel of firearms with the above-mentioned chemical composition has proven to be particularly advantageous and efficient. According to the method, a quenching and tempering is carried out as a vacuum heat treatment, in which a hardening is carried out at least once with a forced cooling from a temperature of above 940° C., but lower than 995° C., with a retention time at hardening temperature after a partial through-heating of at least 20 min., and a tempering of the hardening structure carried out at least twice at a temperature of more than 575° C.

Further improved quality properties can be achieved if a hardening of the gun barrel material from a temperature in the range of 960 to 980° C. after a retention time at this austenization temperature of more than 25 min. takes place. As a result, a tempering is carried out multiple times at a temperature of approximately 600° C.

This is explained in more detail based on test results, which represent only one way of carrying out the invention. The measured values of the tests are shown in diagrams.

Embodiments of the invention are directed to a gun barrel for firearms made from a deformed material comprising a chemical composition in % by weight of:

| Content | C | Si | Mn | P | S | Cr | Mo | Ni | V | W | Ti | As + Sn + Sb | Fe |
|---|---|---|---|---|---|---|---|---|---|---|---|---|---|
| Min | 0.28 | 0.08 | 0.15 | | | 3.6 | 1.2 | | 0.42 | | | | Rest |
| Max | 0.36 | 0.26 | 0.35 | 0.005 | 0.002 | 4.4 | 1.8 | <0.5 | 0.5 | 0.15 | 0.08 | 0.007 | |

and impurities due to smelting. The material has a hardness of at least 46 to 48 HRC.

According to features of the embodiments, the firearms can include lightweight small arms and the material is heat treated.

In accordance with other embodiments of the invention, the chemical composition in % by weight of the deformed material may include:

| Content | C | Si | Mn | P | S | Cr | Mo | Ni | V | W | Ti | As + Sn + Sb | Fe |
|---|---|---|---|---|---|---|---|---|---|---|---|---|---|
| Min | 0.28 | 0.08 | 0.15 | | | 3.6 | 1.2 | | 0.42 | | | | Rest |
| Max | 0.36 | 0.26 | 0.35 | 0.005 | 0.002 | 4.4 | 1.8 | 0.18 | 0.5 | 0.15 | 0.08 | 0.007 | |

and impurities due to smelting. The material is heat treated with a hardness of at least 46 to 48 HRC.

According to embodiments of the present invention, the material can include at least one element with the concentration in % by weight of:

| Content | C | Si | Mn | P | S | Cr | Mo | Ni | V | W | Ti | As + Sn + Sb | Fe |
|---|---|---|---|---|---|---|---|---|---|---|---|---|---|
| Min | 0.3 | 0.1 | 0.2 | | | 3.8 | 1.4 | | 0.44 | | | | Rest |
| Max | 0.34 | 0.2 | 0.3 | 0.005 | 0.001 | 4.2 | 1.6 | 0.1 | 0.48 | 0.1 | 0.05 | 0.005 | |

Embodiments of the invention are directed to a method for producing the above-described gun barrel for firearms. The method includes quenching and tempering the material in a vacuum heat treatment, hardening the material at least once at a temperature above 940° C., but lower than 995° C., with a retention time at the hardening temperature after a partial through-heating of at least 20 min., and tempering the hardening material at least twice at a temperature of more than 575° C.

In accordance with features of the embodiments, the material is hardened at a temperature in the range of 960 to 980° C. with a retention time at the austenization temperature of more than 25 min., and the material is tempered multiple times at a temperature of approximately 600° C.

According to other embodiments of the invention, the vacuum treatment of a melt occurs in the production of the material.

Embodiments of the invention are directed to a method for producing a material for gun barrels for firearms. The method includes quenching and tempering the material in a vacuum heat treatment, the material having a chemical composition of: 0.28-0.36% wt. of C; 0.08-0.26% wt. of Si; 0.15-0.35% wt. of Mn; <0.005% wt. of P; <0.002% wt. of S; 3.6-4.4% wt. of Cr; 1.2-1.8% wt. of Mo; <0.5% wt. of Ni; 0.42-0.5% wt. of V; <0.15% wt. of Ti; <0.007% wt. of As+Sb+Sb; with a remainder of Fe and impurities from smelting. The method also includes hardening the material at least once at a temperature between 940° C. and 995° C., with a retention time at the hardening temperature of at least 20 min., and tempering the hardening material at least twice at a temperature of more than 575° C.

According to embodiments, the material has a hardness of at least 46 HRC.

In accordance with still yet other embodiments of the present invention, the chemical composition of the material has a Ni content of <0.18% wt.

Other exemplary embodiments and advantages of the present invention may be ascertained by reviewing the present disclosure and the accompanying drawing.

BRIEF DESCRIPTION OF THE DRAWINGS

The present invention is further described in the detailed description which follows, in reference to the noted plurality of drawings by way of non-limiting examples of exemplary embodiments of the present invention, in which like reference numerals represent similar parts throughout the several views of the drawings, and wherein.

DETAILED DESCRIPTION OF THE EMBODIMENTS

The particulars shown herein are by way of example and for purposes of illustrative discussion of the embodiments of the present invention only and are presented in the cause of providing what is believed to be the most useful and readily understood description of the principles and conceptual aspects of the present invention. In this regard, no attempt is made to show structural details of the present invention in more detail than is necessary for the fundamental understanding of the present invention, the description taken with the drawings making apparent to those skilled in the art how the several forms of the present invention may be embodied in practice.

Table 1 shows chemical compositions for the exemplary embodiment for comparison of other alloys or materials used for gun barrels. In Table 1, a quenched and tempered steel V320, a hot-worked steel W300, and a steel type W381 according to the embodiments of invention for gun barrels having the contents of alloying elements shown below, with the residual content being essentially iron:

TABLE 1

| Quality | | C | Si | Mn | P | S | Cr | Mo | Ni | V | W | Ti | As + Sn + Sb |
|---|---|---|---|---|---|---|---|---|---|---|---|---|---|
| V320 | Min | 0.4 | 0.2 | 0.6 | | | 1.0 | 0.15 | 0.2 | | | | |
| | Max | 0.44 | 0.35 | 0.8 | 0.025 | 0.002 | 1.2 | 0.25 | 0.3 | 0.1 | 0.1 | 0.05 | 0.01 |
| W300 | Min | 0.36 | 0.9 | 0.3 | | | 4.8 | 1.1 | | 0.3 | | | |
| | Max | 0.4 | 1.2 | 0.5 | 0.025 | 0.002 | 5.2 | 1.3 | 0.4 | 0.5 | 0.1 | 0.05 | 0.01 |
| W381 | Min | 0.28 | 0.08 | 0.15 | | | 3.6 | 1.2 | | 0.42 | | | |
| | Max | 0.36 | 0.26 | 0.35 | 0.005 | 0.002 | 4.4 | 1.8 | 0.18 | 0.5 | 0.15 | 0.08 | 0.07 |

All of the above-identified gun barrel steels used for a test were subjected to a vacuum heat treatment with the same parameters:

Austenization at hardening temperature;

Retention at the austenization temperature for 30 min. and quenching; and

Tempering twice for respectively 2 hours.

Figure 1:
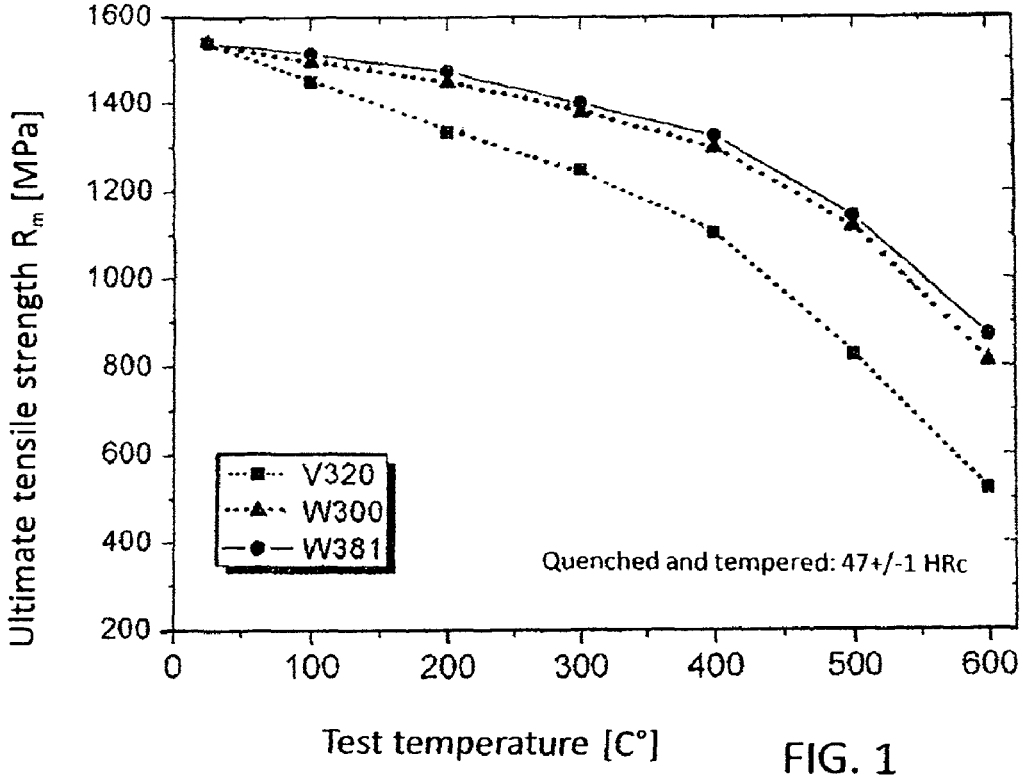
FIG. 1 illustrates high-temperature stability of the materials as a function of the temperature.

FIG. 1 shows the curve of the ultimate tensile strength $R_m$ with rising temperature up to 600° C.

The strength $R_m$ is already substantially reduced with the quenched and tempered steel V320 at a temperature of over 200° C. Further, from approx. 390° C. after frequent heating, this alloy no longer meets the current requirements for a gun barrel material.

The material W381 according to the embodiments of the invention and the hot-worked steel W300, however, do not show a reduction in ultimate tensile strength below the required limit until a temperature of approx. 500° C.

Figure 2:
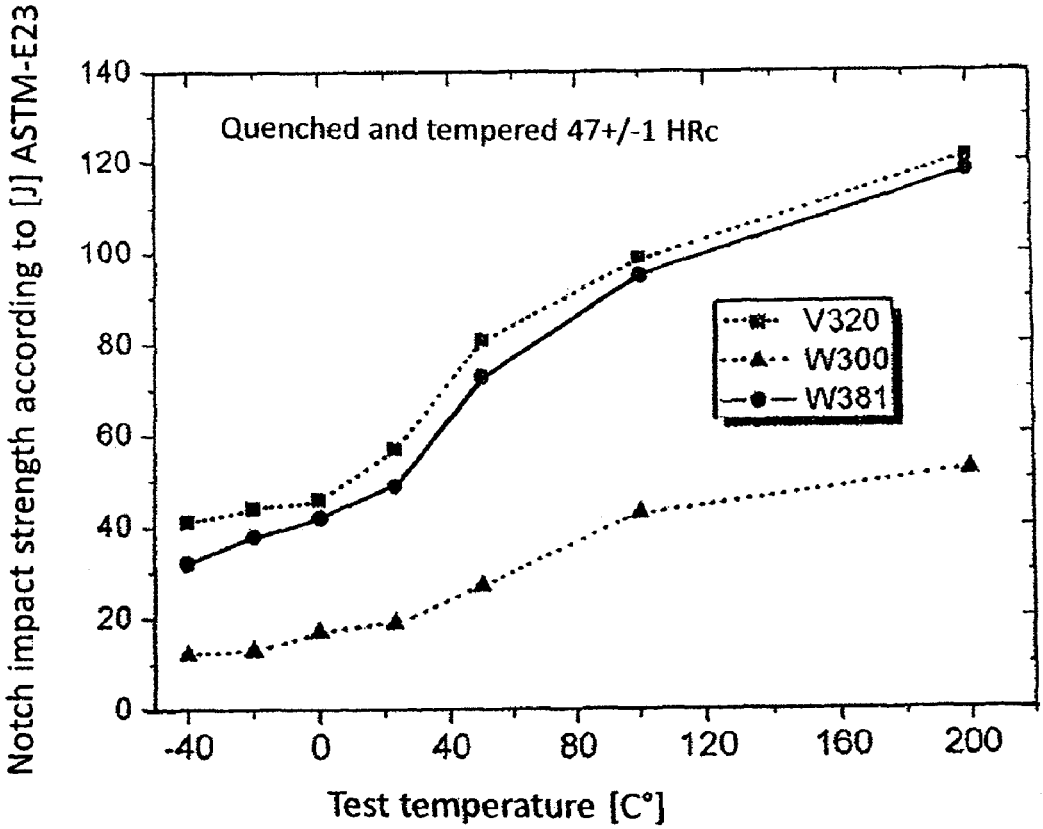
FIG. 2 illustrates a notch impact strength (toughness) of the materials as a function of the temperature

FIG. 2 shows the curve of the material toughness over the temperature in the range from −40 and +200° C.

From this plot, it can be seen from the curve trace that the hot-worked steel W300 overall exhibits lower toughness values and, from a temperature of less than 20° C., a brittle fracture tendency of the material is dominant.

The quenched and tempered steel V320 shows a tough break behavior with impact stress of parts made thereof. The material W381 according to the embodiments of the invention has only slightly lower toughness values at the individual temperatures.

In comparison, the gun barrel according to the embodiments comprises a material W381, which exhibits a much greater ultimate tensile strength and hardness at higher temperatures than the quenched and tempered steel V320 conventionally used. Further, material W381 has a much higher toughness potential at low temperatures down to −40° C.

It is noted that the foregoing examples have been provided merely for the purpose of explanation and are in no way to be construed as limiting of the present invention. While the present invention has been described with reference to an exemplary embodiment, it is understood that the words which have been used herein are words of description and illustration, rather than words of limitation. Changes may be made, within the purview of the appended claims, as presently stated and as amended, without departing from the scope and spirit of the present invention in its aspects. Although the present invention has been described herein with reference to particular means, materials and embodiments, the present invention is not intended to be limited to the particulars disclosed herein; rather, the present invention extends to all functionally equivalent structures, methods and uses, such as are within the scope of the appended claims.

What is claimed:

1. A gun barrel for firearms made from a deformed material comprising a chemical composition in % by weight of:

| Content | C | Si | Mn | P | S | Cr | Mo |
|---|---|---|---|---|---|---|---|
| Min | 0.28 | 0.08 | 0.15 | 0 | 0 | 3.6 | 1.2 |
| Max | 0.36 | 0.26 | 0.35 | 0.005 | 0.002 | 4.4 | 1.8 |

| Content | Ni | V | W | Ti | As + Sn + Sb | Fe |
|---|---|---|---|---|---|---|
| Min | 0 | 0.42 | 0 | 0 | 0 | Rest |
| Max | <0.5 | 0.5 | 0.15 | 0.08 | 0.007 | Rest |

and impurities due to smelting, wherein the material has a hardness of at least 46 to 48 HRC.

2. The gun barrel in accordance with claim 1, wherein the firearms comprise lightweight small arms and the material is heat treated.

3. The gun barrel in accordance with claim 1, wherein the chemical composition in % by weight of the deformed material comprises:

| Content | C | Si | Mn | P | S | Cr | Mo | Ni | V | W | Ti | As + Sn + Sb | Fe |
|---|---|---|---|---|---|---|---|---|---|---|---|---|---|
| Min | 0.28 | 0.08 | 0.15 | 0 | 0 | 3.6 | 1.2 | 0 | 0.42 | 0 | 0 | 0 | Rest |
| Max | 0.36 | 0.26 | 0.35 | 0.005 | 0.002 | 4.4 | 1.8 | 0.18 | 0.5 | 0.15 | 0.08 | 0.007 | Rest |

and impurities due to smelting, wherein the material is heat treated with a hardness of at least 46 to 48 HRC.

4. The gun barrel in accordance with claim 1, wherein the material comprises at least one element with the concentration in % by weight of:

| Content | C | Si | Mn | P | S | Cr | Mo | Ni | V | W | Ti | As + Sn + Sb | Fe |
|---|---|---|---|---|---|---|---|---|---|---|---|---|---|
| Min | 0.3 | 0.1 | 0.2 | 0 | 0 | 3.8 | 1.4 | 0 | 0.44 | 0 | 0 | 0 | Rest |
| Max | 0.34 | 0.2 | 0.3 | 0.005 | 0.001 | 4.2 | 1.6 | 0.1 | 0.48 | 0.1 | 0.05 | 0.005 | Rest. |

5. The method for producing the gun barrel for firearms in accordance with claim 1, comprising:

quenching and tempering the material in a vacuum heat treatment;

hardening the material at least once at a temperature above 940° C., but lower than 995° C., with a retention time at the hardening temperature after a partial through-heating of at least 20 min.; and tempering the hardening material at least twice at a temperature of more than 575° C.

6. The method in accordance with claim 4, wherein the material is hardened at a temperature in the range of 960 to 980° C. with a retention time at the austenization temperature of more than 25 min., and wherein the material is tempered multiple times at a temperature of approximately 600° C.

7. The method in accordance with claim 5, wherein the vacuum treatment of a melt occurs in the production of the material.

8. A method for producing a material for gun barrels for firearms, comprising:

quenching and tempering the material in a vacuum heat treatment, the material having a chemical composition of: 0.28-0.36% wt, of C; 0.08-0.26% wt. of Si; 0.15-0.35% wt, of Mn; <0.005% wt, of P; <0.002% wt, of S; 3.6-4.4% wt, of Cr; 1.2-1.8% wt, of Mo; <0.5% wt, of Ni; 0.42-0.5% wt, of V; <0.15% wt, of Ti; <0.007% wt, of As+Sb+Sb; with a remainder of Fe and impurities from smelting;

hardening the material at least once at a temperature between 940° C. and 995° C., with a retention time at the hardening temperature of at least 20 min.; and tempering the hardening material at least twice at a temperature of more than 575° C.

9. The method in accordance with claim 8, wherein the material has a hardness of at least 46 HRC.

10. The method in accordance with claim 8, wherein the chemical composition of the material has a Ni content of <0.18% wt.

* * * * *